US008138433B2

(12) United States Patent
Czarnecki et al.

(10) Patent No.: US 8,138,433 B2
(45) Date of Patent: Mar. 20, 2012

(54) SEQUENCED SEPARATELY-DERIVED TRANSFER SWITCH CAPABLE OF SWITCHING A LOAD BETWEEN A PAIR OF POWER SUPPLIES WITHOUT INTRODUCING OPEN NEUTRAL SWITCHING TRANSIENTS

(75) Inventors: Neil A. Czarnecki, Mt. Pleasant, WI (US); David D. Flegel, Racine, WI (US); Michael O. Flegel, Racine, WI (US)

(73) Assignee: Reliance Controls Corporation, Racine, WI (US)

( * ) Notice: Subject to any disclaimer, the term of this patent is extended or adjusted under 35 U.S.C. 154(b) by 306 days.

(21) Appl. No.: 12/608,517

(22) Filed: Oct. 29, 2009

(65) Prior Publication Data

US 2011/0100787 A1 May 5, 2011

(51) Int. Cl.
*H01H 9/26* (2006.01)

(52) U.S. Cl. ..... 200/50.32

(58) Field of Classification Search ..... 200/1 R, 200/1 B, 1 V, 17 R, 18, 50.01, 50.32–50.4, 200/330, 331, 334; 361/631–635, 643, 616; 307/64, 80, 115, 23, 126, 125, 130, 139, 307/141

See application file for complete search history.

(56) References Cited

U.S. PATENT DOCUMENTS

| | | | | |
|---|---|---|---|---|
| 5,204,803 | A | 4/1993 | Runge | |
| 5,648,646 | A | 7/1997 | Flegel | |
| 5,805,414 | A | 9/1998 | Feldhaeusser | |
| 5,835,341 | A | 11/1998 | Rhodes et al. | |
| 6,031,193 | A | 2/2000 | Flegel | |
| 6,096,986 | A | 8/2000 | Flegel | |
| 6,184,595 | B1 | 2/2001 | Flegel | |
| 6,521,849 | B1 | 2/2003 | Flegel | |
| 6,621,689 | B1 | 9/2003 | Flegel | |
| 6,927,349 | B1 | 8/2005 | Flegel et al. | |
| 7,211,750 | B2 * | 5/2007 | Fillppenko | 200/50.32 |
| 7,268,308 | B1 * | 9/2007 | Caudill et al. | 200/50.35 |
| 7,402,766 | B1 * | 7/2008 | Jonas et al. | 200/50.33 |
| 7,446,270 | B2 * | 11/2008 | Somalingayya et al. | 200/50.32 |
| 7,462,791 | B1 * | 12/2008 | Flegel | 200/50.32 |
| 7,834,282 | B2 * | 11/2010 | Flegel | 200/50.32 |
| 8,040,663 | B1 * | 10/2011 | Czarnecki | 361/632 |
| 2002/0157931 | A1 * | 10/2002 | Smith | 200/50.33 |
| 2007/0278071 | A1 * | 12/2007 | Flegel | 200/50.33 |
| 2010/0187075 | A1 * | 7/2010 | Flegel | 200/50.32 |

OTHER PUBLICATIONS

"Main Lugs Generator Panel", Schneider Electric, www.Schneider-electric.ca/www/en/products/stab-lok/html/lugsgenerator.htm, Mar. 26, 2004, 3 pages.

* cited by examiner

*Primary Examiner* — Michael Friedhofer
(74) *Attorney, Agent, or Firm* — Boyle Fredrickson, S.C.

(57) ABSTRACT

An interlock arrangement operatively associated with utility and generator side switches of an electrical panel including a first main switch associated with the first power supply and a second main switch associated with the second power supply. The interlock arrangement includes a first neutral switch associated with the first power supply, and a second neutral switch associated with the second power supply. A lockout sequencer arrangement has a first lockout that restricts simultaneous switching of the first and the second neutral switch, a second lockout configured to engage the first lockout to restrict movement of the first lockout when the first main switch is a conductive position, and a third lockout configured to engage the first lockout to restrict movement of the first lockout when the second main switch is in a conductive position.

21 Claims, 13 Drawing Sheets

SEQUENCED SEPARATELY-DERIVED TRANSFER SWITCH CAPABLE OF SWITCHING A LOAD BETWEEN A PAIR OF POWER SUPPLIES WITHOUT INTRODUCING OPEN NEUTRAL SWITCHING TRANSIENTS

BACKGROUND AND SUMMARY OF THE INVENTION

This invention relates to a transfer switch and, more particularly, to a separately-derived transfer switch having a lockout sequencing arrangement that sequences manual switching of a load between power supplies to prevent open neutral transients during the switching.

In an electrical supply system, there are occasions when an alternate source of electric power is necessary or desirable. For example, the capability of switching from utility power to emergency generator power is important for businesses, hospitals and industries, and is also employed in residential applications.

It is desirable for separate electrical circuits, or separate groups of electrical circuits, to be arranged so that when one group of circuits is switched to a conductive state, another group of circuits is switched to a non-conductive state so as to prevent power supply to the circuits from two different power sources at the same time, e.g. from both a utility power supply and a generator power supply. In an arrangement such as this, a switch is typically provided for each power source to control the supply of electrical power. Accordingly, it is important to ensure that the switches are prevented from both being in the ON position at the same time, to ensure that power is supplied to the switch from only one power source.

To this end, switch interlocks have been developed that are designed to prevent simultaneous connection of circuits to two different power sources, such as described in U.S. Pat. No. 6,096,986, the disclosure of which is incorporated herein and assigned to the assignee of the present application. For some transfer switches, providing linkages that prevent the inadvertent switching of circuits to two power supplies is sufficient. However, for some types of transfer switches, more than an interlock is needed. For instance, if a separately-derived transfer switch is not properly switched, open neutral switching transients may be introduced.

The present invention is directed to a sequencing lockout arrangement for use with a separately-derived transfer switch that sequences manual switching of main and generator side switches to prevent the introduction of open neutral switching transients. A separately-derived transfer switch typically includes a utility mains switch or breaker and a utility mains neutral switch as well as a generator mains switch or breaker and a generator mains neutral switch. In one embodiment of the present invention, two slidable lockout sequencers together with a rocker lockout functions to sequence switching of a load from one power source to another power source. In this embodiment, seven separate operations must be performed to switch the load between power sources. In another embodiment, the utility mains neutral and generator mains neutral switches are linked together such that switching of the utility mains neutral to a conductive position automatically switches the generator mains neutral switch to a non-conductive position, and vice-versa. In this embodiment, five separate operations are required to switch a load between power sources.

The slidable lockout sequencers together with the rocker lockout in the first-mentioned embodiment allow only one of the utility mains breaker, the utility mains neutral switch, the generator mains breaker, and the generator mains neutral switch to be switched at a time. Moreover, the lockout sequencers and the rocker lockout cooperate such that a predefined order or sequence of the one-at-a-time switching must be followed to switch a load from one power source to another. The slidable lockout sequencers similarly define the sequence of switching with the interlinked neutral switches of the second-mentioned embodiment. Thus, in both embodiments, the slidable lockout sequencers provide limited and ordered switching of the utility and generator switches.

Thus, it is one object of the present invention to provide a lockout arrangement for use with a separately-derived transfer switch that is operable to prevent open neutral switching transients.

It is another object of the present invention to provide a separately-derived transfer switch having a pair of slidable members that restrict movement of switch handles such that a load is switched from one power source to another in a predefined, unalterable sequence.

In accordance with one aspect of the present invention, these and other objects are achieved with a lockout arrangement for use with a separately-derived transfer switch having a mains switch, a generator switch, a mains neutral switch, and a generator neutral switch. The lockout arrangement includes a neutral interlock associated with the mains neutral switch and the generator neutral switch, and configured to prevent both neutral switches from being in a conductive position simultaneously. The neutral interlock includes a first bracket engaged with the mains neutral switch and a second bracket engaged with the generator neutral switch. The brackets are adapted to move in response to movement of a neutral switch. The lockout arrangement further includes a first interlock configured to engage the first bracket to prevent movement of the first bracket, and a second interlock configured engage the second bracket to prevent movement of the second bracket. The first and second interlocks are arranged such that the interlocks cannot be engaged with their respective brackets simultaneously.

In accordance with another aspect, the invention is directed to a separately-derived transfer switch having a first mains switch associated with a first power supply and a second mains switch associated with a second power supply. The transfer switch further includes a first neutral switch and a second mains neutral switch associated with the first and the second power supplies, respectively. A lockout sequencing arrangement has a first lockout that restricts simultaneous switching of the first and the second neutral switch and further includes a second lockout configured to engage the first lockout to restrict movement of the first lockout when the first main switch is a conductive position, and a third lockout configured to engage the first lockout to restrict movement of the first lockout when the second main switch is in a conductive position.

The present invention may also be embodied in a method of disconnecting a load from a utility power supply and connecting the load to a generator. The method includes switching a mains switch from an ON position to an OFF position. The method continues with disengaging a mains side lockout from engagement with a neutral switch assembly lockout to allow movement of a mains neutral switch and a generator neutral switch. The method further includes switching, in tandem, the mains neutral switch from an ON position to an OFF position and the generator neutral switch from an OFF position to an ON position. In addition, the method includes engaging a generator side lockout with the neutral switch assembly lockout to prevent switching of the mains neutral switch and the generator neutral switch, and switching a generator switch from an OFF position to an ON position The above series of steps may be performed in a reverse order to disconnect the load from the generator and to connect the load to the utility power supply.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

Figure 1:
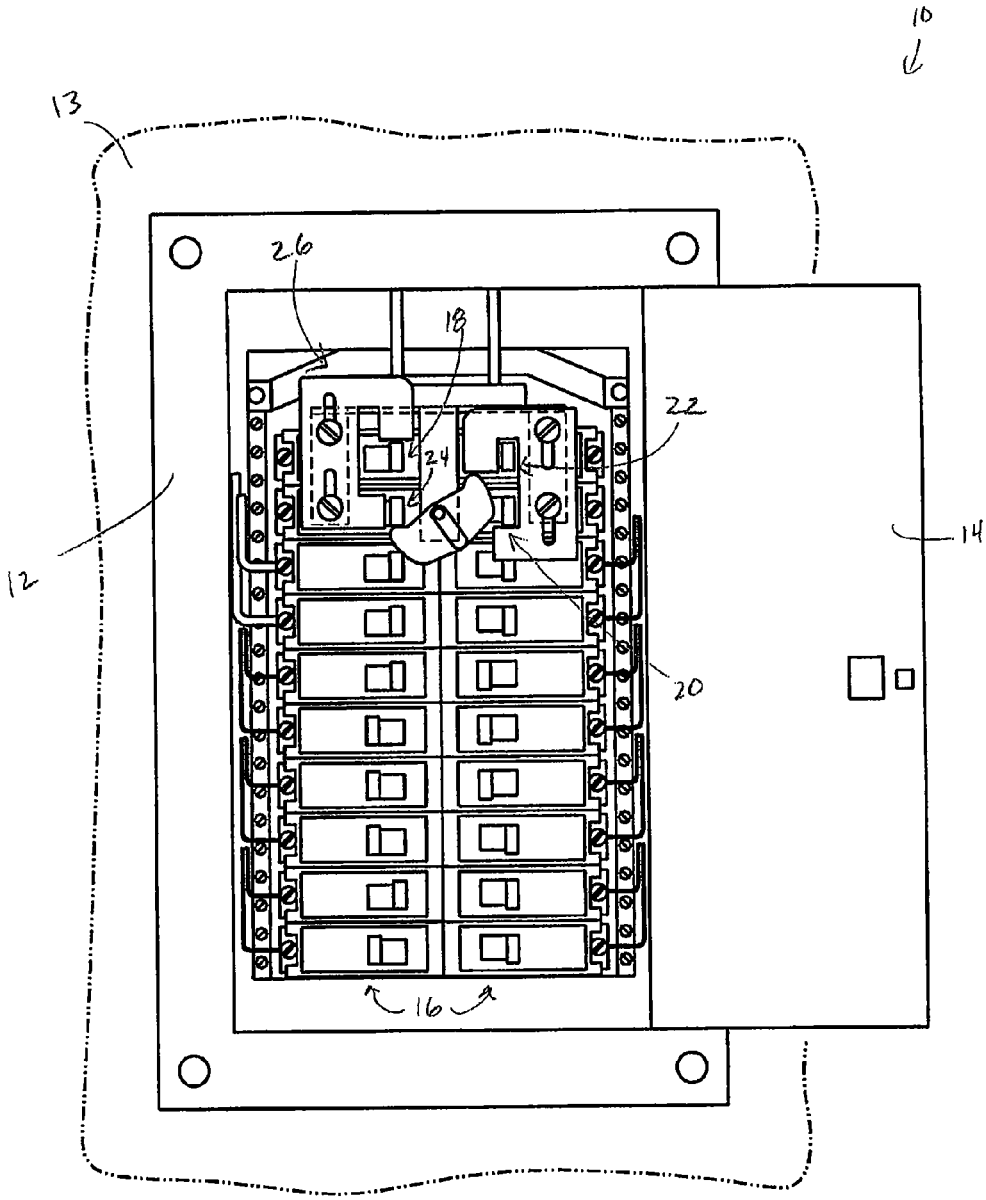
FIG. 1 is a front elevation view of a transfer panel containing a utility mains breaker, a utility mains neutral switch, a generator mains breaker, and a generator mains neutral switch together with a lockout arrangement containing two slidable lockout sequencers and a rocker lockout according to one embodiment of the present invention and shown with the utility mains breaker and the mains neutral switch in an ON position and the generator mains breaker and the generator mains neutral switch in an OFF position.

FIG. 1 shows a load center assembly 10 according to one embodiment of the present invention, which is configured to supply power to a series of electrical circuits from one of at least two power sources. Representatively, load center assembly 10 controls the supply of power to the electrical circuits from a primary power source, such as utility power, and an alternate or secondary power source, such as an electric generator, which is adapted to supply power in the event power from the primary power source is unavailable. Typically, the alternate or secondary power source is an electric generator, although it is understood that any other source of secondary or alternate power may be employed. The following description utilizes terminology which makes reference in various instances to a generator, and it is understood that such terminology is used for the sake of convenience and that the term "generator" is meant to encompass any secondary or alternate power source, and is not limited to a generator as the alternate power source. Similarly, it is understood that use of the term "utility" is meant to encompass any primary power source, and is not limited to power provided through a utility company power grid.

Load center assembly 10 includes a cover 12 adapted to be mounted to wall 13 and having a door 14 pivotably connected thereto. Cover 12 includes a series of knockouts constructed to be removed as load breakers 16 are added. In the illustrated embodiment, each of the knockouts has been removed and loaded with breakers 16. Further, in the illustrated embodiment, the knockouts, and thus breakers 16, are arranged in two columns, but it is understood that other layouts are possible. A utility mains switch or breaker 18 is constructed to be connected to a utility power input. A generator mains neutral switch 20, generator mains breaker 22, and a utility mains neutral switch 24 are constructed to be electrically connected to the respective power sources, as known in the art. The load center assembly 10 further has an interlock assembly 26 that prevents the inadvertent connection of the utility power input via utility mains breaker 18 and generator power input via generator mains breaker 22 from being concurrently connected to the load terminals of the load center assembly 10. As will be explained, the interlock assembly 26 also controls movement of the neutral switches 20, 24 to ensure that the breakers and switches are actuated in a predefined sequence.

Figure 2:
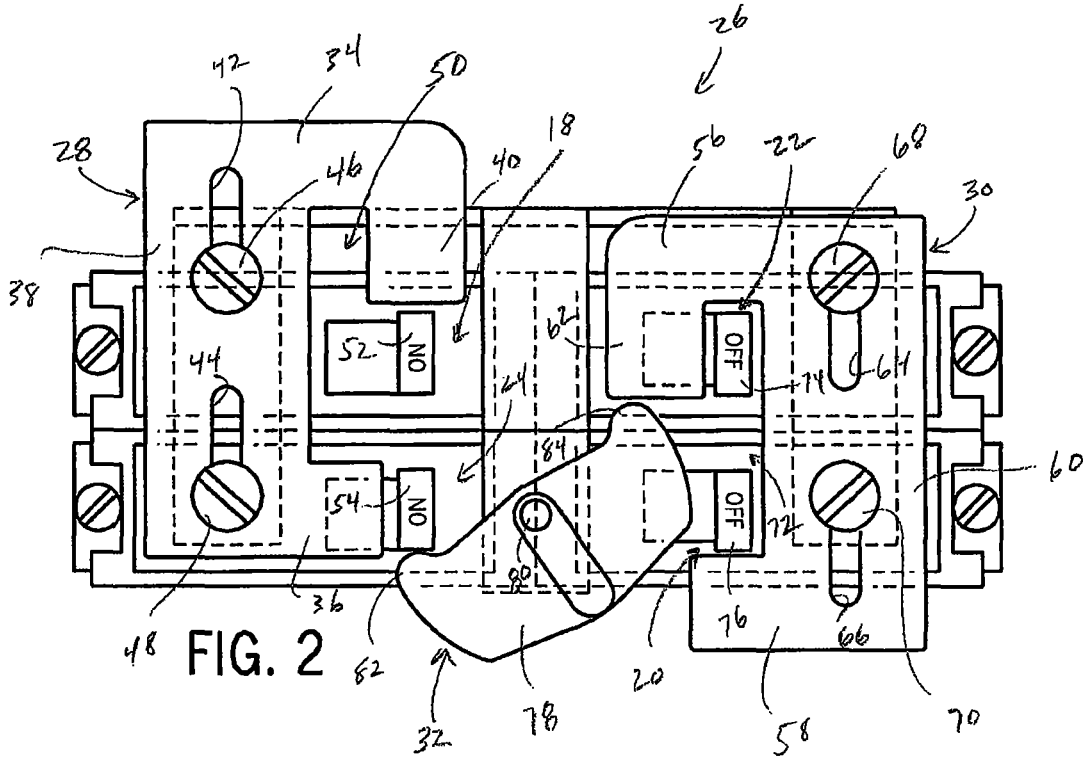
FIG. 2 is an enlarged view of the transfer panel of FIG. 1 showing the utility mains breaker and the utility mains neutral switch in the ON position and the generator mains breaker and the generator mains neutral switch in the OFF position.

Referring now to FIG. 2, the interlock assembly 26 includes a pair of slidable lockouts 28, 30 and a centrally positioned rocker lockout 32. Lockout 28 is associated with the utility mains breaker 18 and the utility mains neutral switch 24, and thus will be referred to as "utility side lockout" whereas lockout 30 is associated with the generator mains breaker 22 and the generator mains neutral switch 20, and thus will be referred to as "generator side lockout".

The utility side lockout 28 includes a header 34, a shorted base 36, a first leg 38, and a second shortened leg 40. It is understood that the lockout 28 may fabricated as a single unitary body or the header 34, base 36, and legs 38, 40 may be fastened together using conventional fasteners. The first leg 38 includes first and second slots 42, 44 that are vertically spaced from and aligned with one another. Respective alignment pins 46, 48 extend through the openings and define a range of motion for the utility side lockout 28. The arrangement of the header 34, shortened base 36, leg 38, and shortened leg 40 collectively define a recess 50 sized to receive the handles 52 and 54 of the utility mains breaker 18 and the utility mains neutral switch 24, respectively.

The generator side lockout 30 is similar in construction to the utility side lockout 28. The generator side lockout 30 includes a header 56, a shorted base 58, a first leg 60, and a second shortened leg 62. It is understood that the lockout 30 may also be fabricated as a single unitary body or the header 56, base 58, and legs 60, 62 may be fastened together using conventional fasteners. The first leg 60 includes first and second slots 64, 66 that are vertically spaced from and aligned with one another. Respective alignment pins 68, 70 extend through the openings and define a range of motion for the utility side lockout 30. In addition, the alignment pins 68 and 70 are aligned with pins 46 and 48, respectively. The lockout 30 also includes a recess 72 sized to receive the handles 74 and 76 of the generator mains breaker 22 and the generator mains neutral switch 20, respectively.

The rocker lockout 32 includes a rocker body 78 that is positioned generally between utility mains neutral switch 24 and the generator mains neutral switch 20. The rocker body 78 is coupled to a pivot pin 80 in a manner that allows the rocker body to be pivoted. Ears 82, 84 extend from the rocker body 78 and as will be explained limit the range of motion of the rocker lockout 32. The ears 82, 84 may be integrally formed with the rocker body 78 or may be separate components that are fastened to the rocker body 78 in a conventional manner.

In FIG. 2, the utility mains breaker switch handle 52 and the utility mains neutral switch handle 54 are both in the ON position and the generator mains breaker handle 74 and the generator mains neutral switch handle 76 are in the OFF position. When the breakers and switches are in this position, the load circuits of the load center assembly 10 are electrically connected to the utility power source. The interlock arrangement 26 is constructed and associated with the breakers and switch handles such that generator side handles 74, 76 cannot be moved to their ON positions when the utility side handles 52, 54 are in the ON position. Moreover, the utility mains neutral switch handle 54 is blocked from being moved to the OFF position by the shortened base 36 of the generator side lockout 28. For the utility mains neutral switch handle 54 to be in the ON position shown in FIG. 2, the rocker lockout 32 must be pivoted counterclockwise. This movement is only possible if the generator mains neutral switch handle 76 is in the OFF position. In addition, once the rocker lockout 32 is pivoted to the position shown in FIG. 2, the generator mains neutral switch handle 76 cannot be switched from the OFF position to the ON position.

The interlock assembly 26 forces an operator to complete a seven step sequence to manually disconnect the load center from one power source and connect it to the other power source. The seven step sequence for disconnecting the load center from the utility power source and connecting it to the generator is shown in FIGS. 3 through 10.

Figure 3:
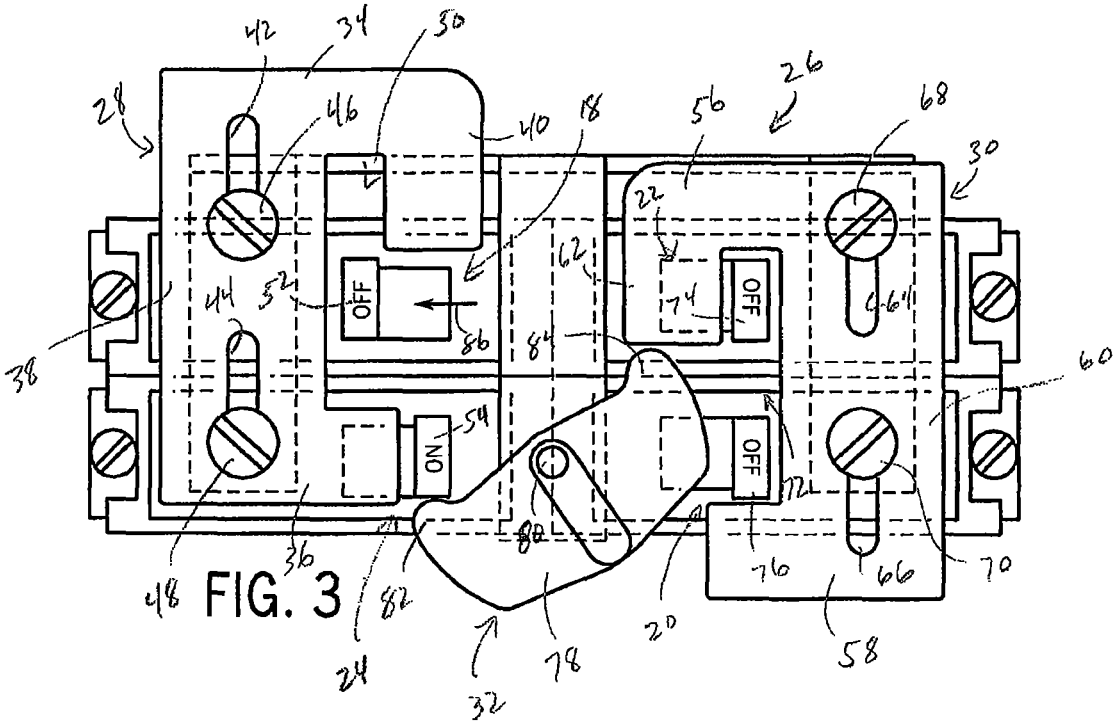
FIG. 3 is a front elevation view of the transfer panel shown in FIG. 2 with the utility mains breaker switched to an OFF position.

In the first step, shown in FIG. 3, the utility mains breaker handle 52 is moved outwardly in the direction of arrow 86 from the ON position to the OFF position. As a result of this outward movement, the switch handle 52 is moved to a position within recess 50 of the utility side lockout 28. Additionally, as a result of this movement, the switch handle 52 no longer blocks downward movement of the lockout 28. More specifically, when the switch handle 52 is in the ON position, FIG. 2, the shorted leg 40 of the lockout 28 is generally adjacent the switch handle 52. As a result, the lockout 28 cannot be slid downward along arrow 88, shown in FIG. 4.

Figure 4:
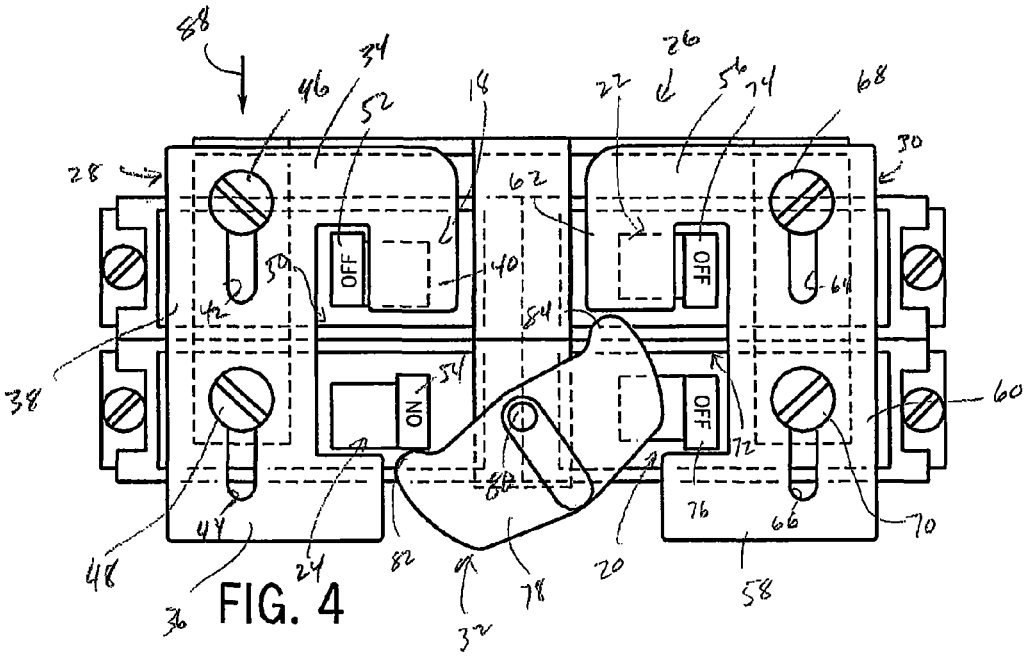
FIG. 4 is a front elevation view of the transfer panel shown in FIG. 2 with a mains side lockout sequencer having been slid to free the utility mains neutral switch.

In step 2, downward movement of the generator side lockout 28 causes the shorted leg 40 to move adjacent the utility mains breaker handle 52, as shown in FIG. 4. In this position, the switch handle 52 cannot be moved back to its ON position until the lockout 28 is slid upward. In addition, as shown in FIG. 4, the shortened base 36 of the lockout 28 also slides downward to a position below that of the utility mains neutral switch handle 54 thereby freeing the switch handle 54 to be moved to the OFF position.

Figure 5:
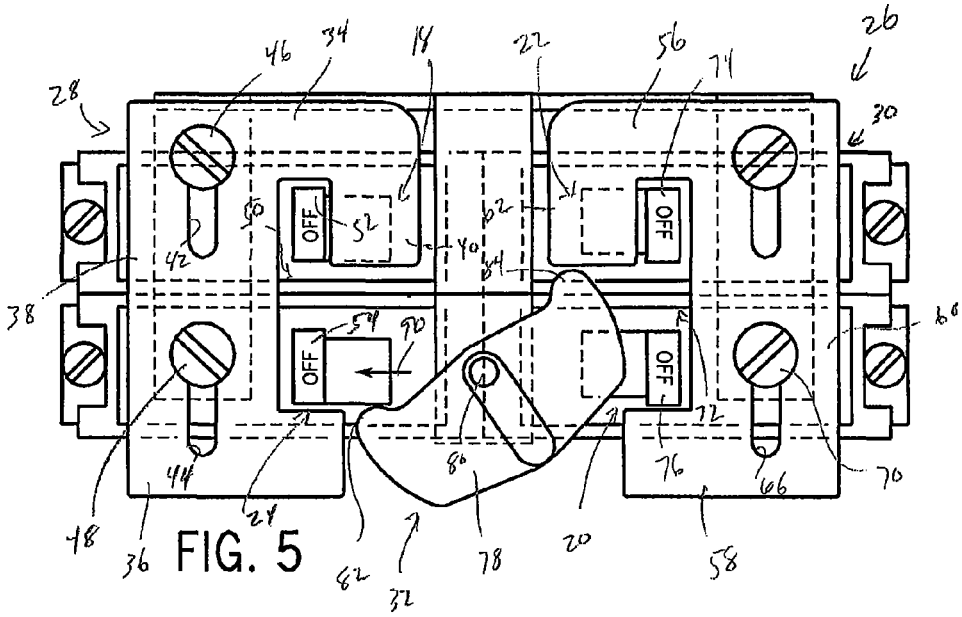
FIG. 5 is a front elevation view of the transfer panel shown in FIG. 2 with the utility mains breaker and the utility mains neutral switch switched to the OFF position and positioned within a recess formed in the mains side lockout sequencer.

Thus, at step 3, the utility mains neutral switch handle 54 can be moved outwardly along arrow 90, as shown in FIG. 5. In this position, both of the utility side switches 52, 54 are in the OFF position as are the generator side switch handles 74, 76. As such, the electrical loads are not being fed power from either power source.

Figure 6:
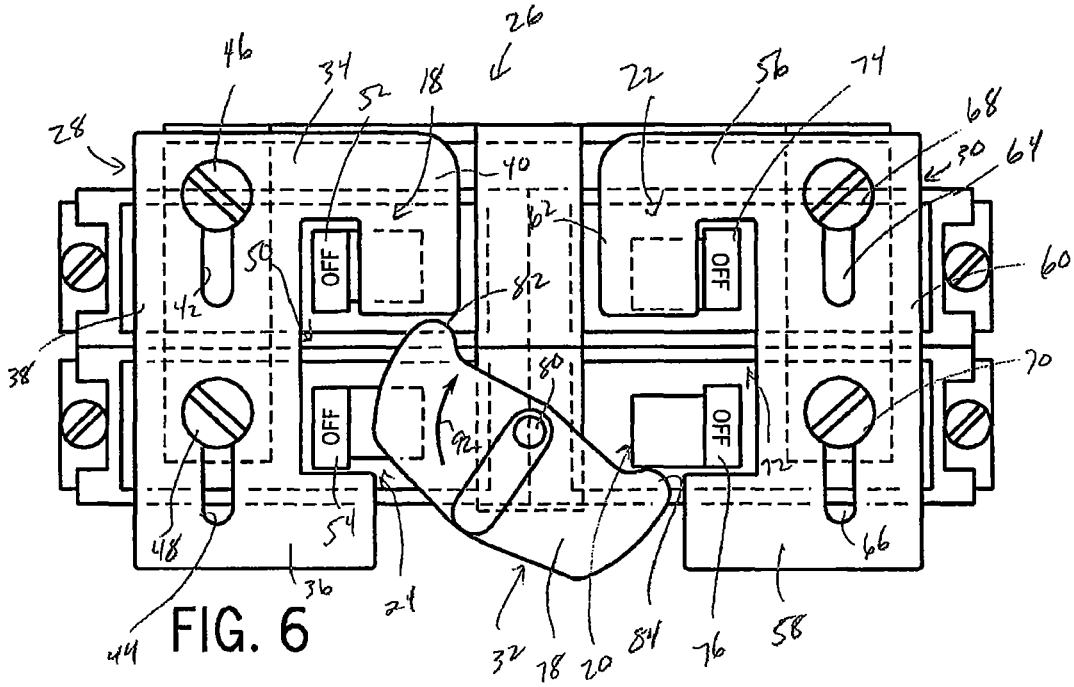
FIG. 6 is a front elevation view of the transfer panel shown in FIG. 2 with the rocker lockout pivoted upward to block the utility mains neutral switch from being switched to the ON position and to free the generator mains neutral switch.

In step 4, shown in FIG. 6, the rocker lockout 32 must be pivoted clockwise, represented by arrow 92, to free the generator mains neutral switch handle 76. This clockwise movement also causes the body 78 of the rocker lockout 32 to move adjacent to the utility mains neutral switch handle 54, which effectively impedes switching back of the switch handle 54 to its ON position. Additionally, ear 82 of the rocker lockout 32 abuts the lower surface of the shortened leg 40 of the utility side lockout 28 when the rocker lockout is fully pivoted to the position shown in FIG. 6. This abutment limits further pivoting of the rocker lockout 32 past the desired position.

Figure 7:
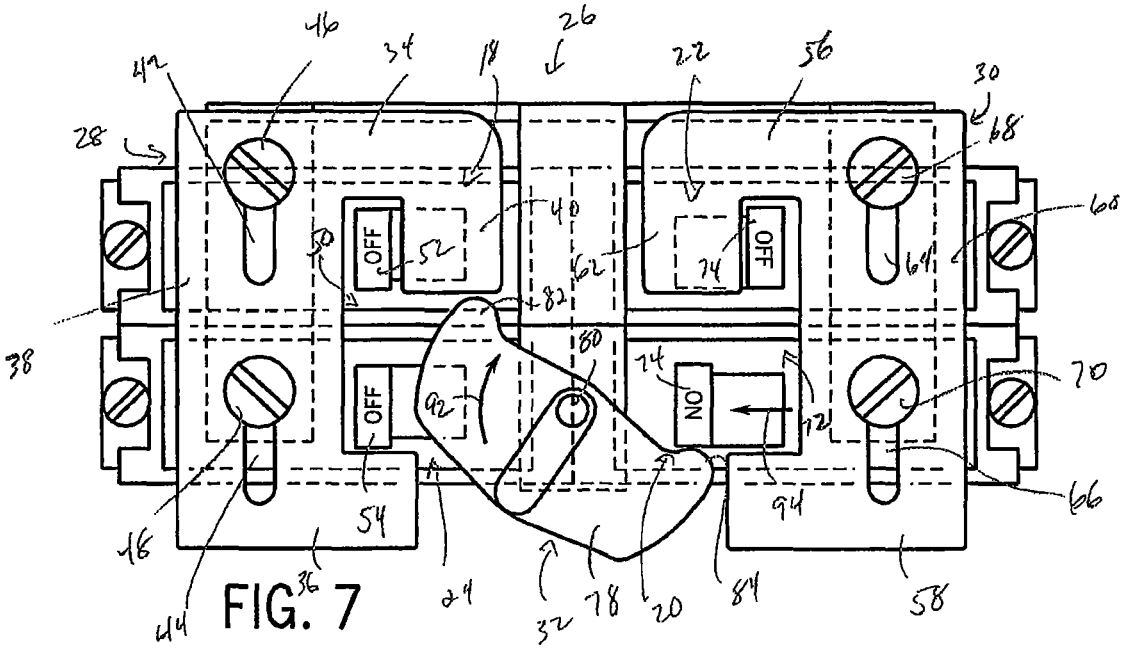
FIG. 7 is a front elevation view of the transfer panel shown in FIG. 2 with the generator mains neutral switch shown switched from an OFF position defined within a recess of a generator side lockout sequencer to an ON position.

With the generator mains neutral switch 76 free by clockwise movement of the rocker lockout 32, in step 5, the operator may then move the generator mains neutral switch handle 76 from the OFF position in the direction of arrow 94 to the ON position, as shown in FIG. 7. As further shown in FIG. 7, when the generator mains neutral switch handle 74 is moved to the ON position, the generator side lockout 30 is free to slide upwardly. More particularly, when the generator mains neutral switch handle 74 is in the OFF position, the switch handle 74 is adjacent the base 58 of the generator side lockout 30 and therefore impedes upward movement of the lockout 30.

Figure 8:
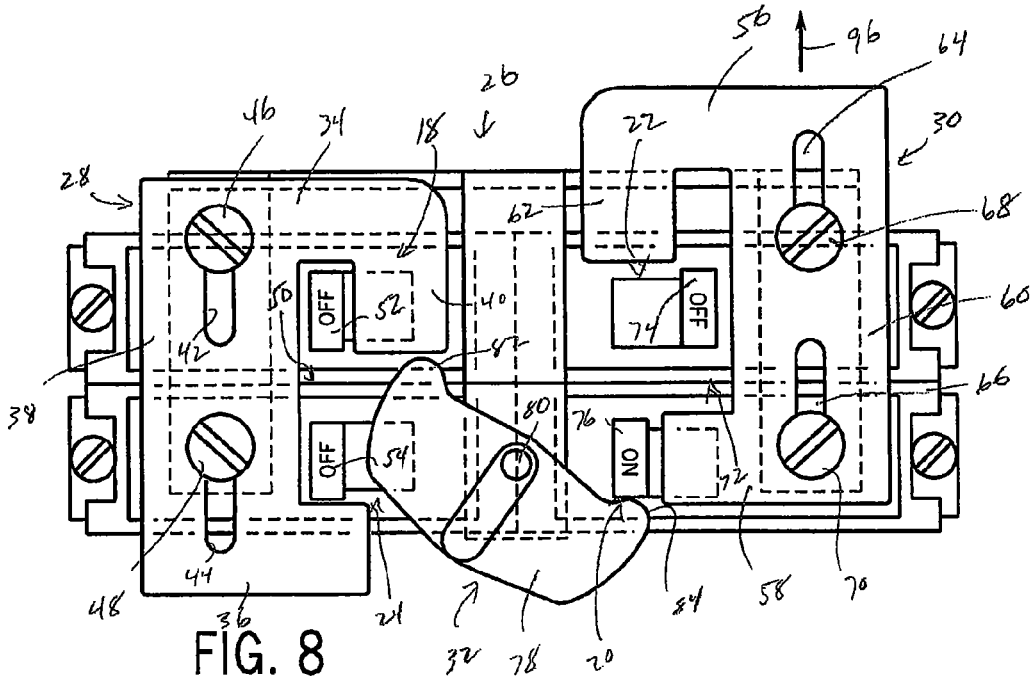
FIG. 8 is a front elevation view of the transfer panel shown in FIG. 2 with the generator side lockout sequencer having been slid to free the generator mains breaker.

In step 6, the generator side lockout 30 is slid upward in the direction of arrow 96, as shown in FIG. 8. As a result of this upward movement, the shorted leg 62 of the lockout 30 that previously was adjacent the generator mains breaker handle 74 is also moved upward away from the switch handle 74. Similarly, the base 58 of the lockout 30 slides upward to sit adjacent the generator mains neutral switch handle 76. In this position, the base 58 blocks the switch handle 76 from being moved back to its OFF position.

Figure 9:
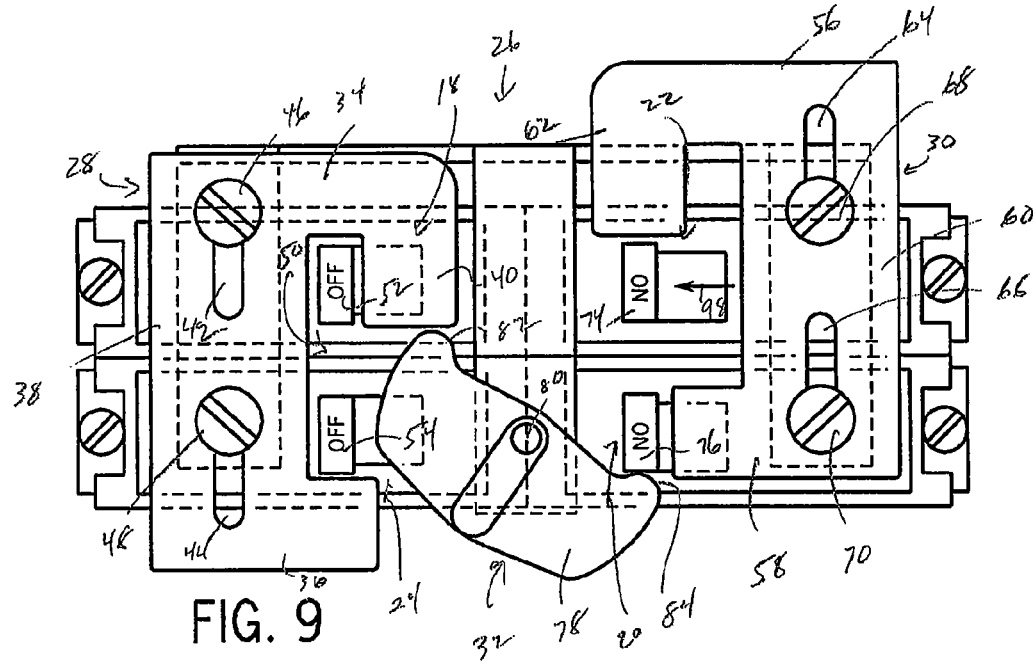
FIG. 9 is a front elevation view of the transfer panel shown in FIG. 2 with the generator mains breaker switch moved to the ON position thereby resulting in connection of a load to the generator power supply.

In step 7, shown in FIG. 9, the generator mains breaker handle 74 is switched from the OFF position to the ON position in the direction of arrow 98. When the generator mains breaker handle 74 is switched to the ON position, the load center is then electrically connected to the generator power source.

One skilled in the art will appreciate that the interlock assembly 26 forces an operator to first switch OFF the utility mains breaker, then switch OFF the utility mains neutral switch, then switch ON the generator mains neutral switch, and then switch ON the generator mains breaker to disconnect the load center 10 from the utility power supply and connect it to the generator power supply. The mechanical configuration of the interlock assembly 26 does not allow the sequence to be adjusted by the operator. In addition, one skilled in the art will appreciate that the steps described above are carried out in reverse to disconnect the load center from the generator power source and connect it to the utility power source.

Figure 10:
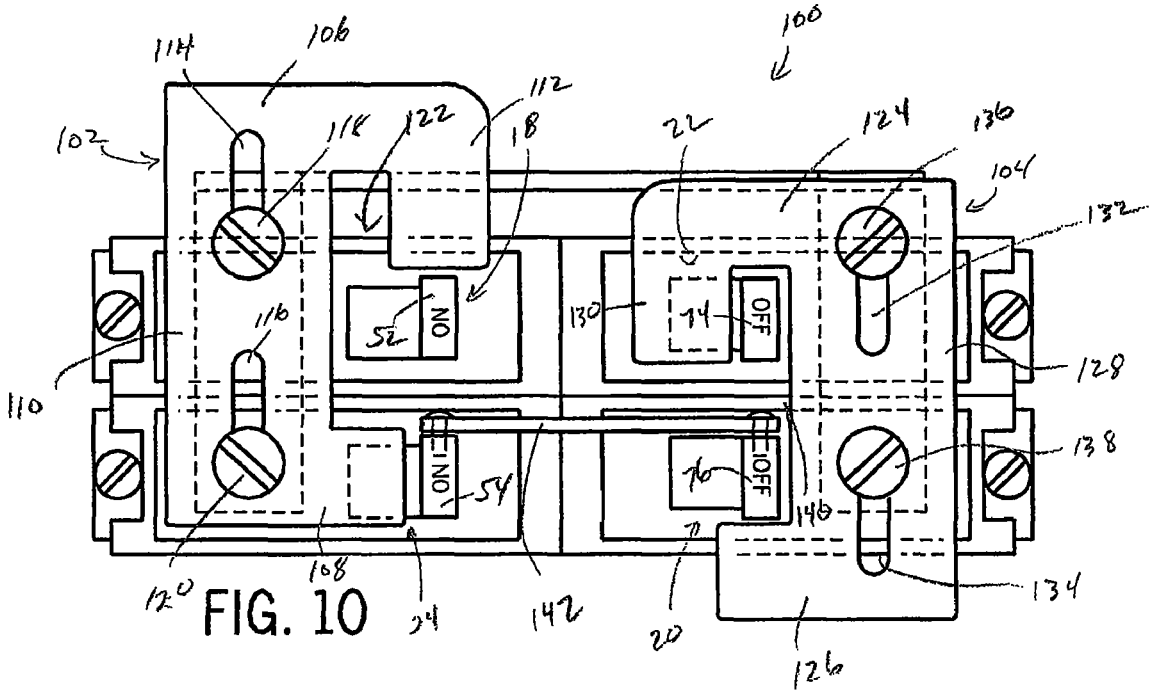
FIG. 10 is a front enlarged elevation view of a transfer panel similar to that shown in FIG. 2 according to another embodiment of the present invention containing a utility mains breaker, a generator mains breaker, and an interlinked utility mains neutral switch and generator mains neutral switch together with a lockout arrangement containing two slidable lockout sequencers and shown with the utility mains breaker and the mains neutral switch in an ON position and the generator mains breaker and the generator mains neutral switch in an OFF position.

Referring now to FIG. 10, an interlock assembly 100 according to another representative embodiment of the present invention is shown. Interlock assembly 100 sequences an operator through five steps to disconnect the load center 10 from one power source and connect it to another power source.

The interlock assembly 100 includes a pair of slidable lockouts 102, 104. Lockout 102 is associated with the utility mains breaker 18 and the utility mains neutral switch 24, and thus will be referred to as "utility side lockout" whereas lockout 104 is associated with the generator mains breaker 22 and the generator mains neutral switch 20, and thus will be referred to as "generator side lockout".

The utility side lockout 102 includes a header 106, a shorted base 108, a first leg 110, and a second shortened leg 112. It is understood that the lockout 102 may fabricated as a single unitary body or the header 106, base 108, and legs 110, 112 may be fastened together using conventional fasteners. The first leg 110 includes first and second slots 114, 116 that are vertically spaced from and aligned with one another. Respective alignment pins 118, 120 extend through the openings and define a range of motion for the utility side lockout 102. Further, the arrangement of the header 106, shortened base 108, leg 110, and shortened leg 112 collectively define a recess 122 sized to receive the handles 52 and 54 of the utility mains breaker 18 and the utility mains neutral switch 24, respectively.

The generator side lockout 104 is similar in construction to the utility side lockout 102. The generator side lockout 104 includes a header 124, a shorted base 126, a first leg 128, and a second shortened leg 130. It is understood that the lockout 104 may also be fabricated as a single unitary body or the header 124, base 126, and legs 128, 130 may be fastened together using conventional fasteners. The first leg 128 includes first and second slots 132, 134 that are vertically spaced from and aligned with one another. Respective alignment pins 136, 138 extend through the openings and define a range of motion for the utility side lockout 104. In addition, the alignment pins 136 and 138 are aligned with pins 118 and 120, respectively. Further, the lockout 104 also includes a recess 140 sized to receive the handles 74 and 76 of the generator mains breaker 22 and the generator mains neutral switch 20, respectively.

The interlock assembly 100 further has an interlinking bar 142 that is connected to the utility mains neutral switch handle 54 and the generator mains neutral switch handle 76. This interlinking of handles 54 and 76 causes the switch handles to be moved simultaneously. Thus, when handle 54 is switched to the OFF position, switch handle 76 is switched to the ON position, and vice-versa. The interlinking bar 142 represents one known means of interconnecting handles 54 and 75. It is understood that other types of interlinking configurations may be used and are considered within the scope of the present invention. One such in-line interlinking configuration is shown in U.S. Pat. No. 6,031,193, the disclosure of which is incorporated herein by reference. Another representative interlinking configuration is described in U.S. Pat. No. 6,927,349, the disclosure of which is incorporated herein by reference.

In general, the interlock assembly 100 is similar to the interlock assembly 26 shown in FIGS. 1 through 9, with the exception that the rocker lockout has been removed and replaced with the interlinking bar 142. By interlinking the neutral switch handles 54, 76, the number of steps to disconnect the load center from one power source and connect it to another power source, relative to the sequence shown in FIGS. 3 through 9 is reduced by two steps. A five-step sequence for disconnecting the load center 10 from the utility power source to the generator power source will be described with respect to FIGS. 11 through 15.

Figure 11:
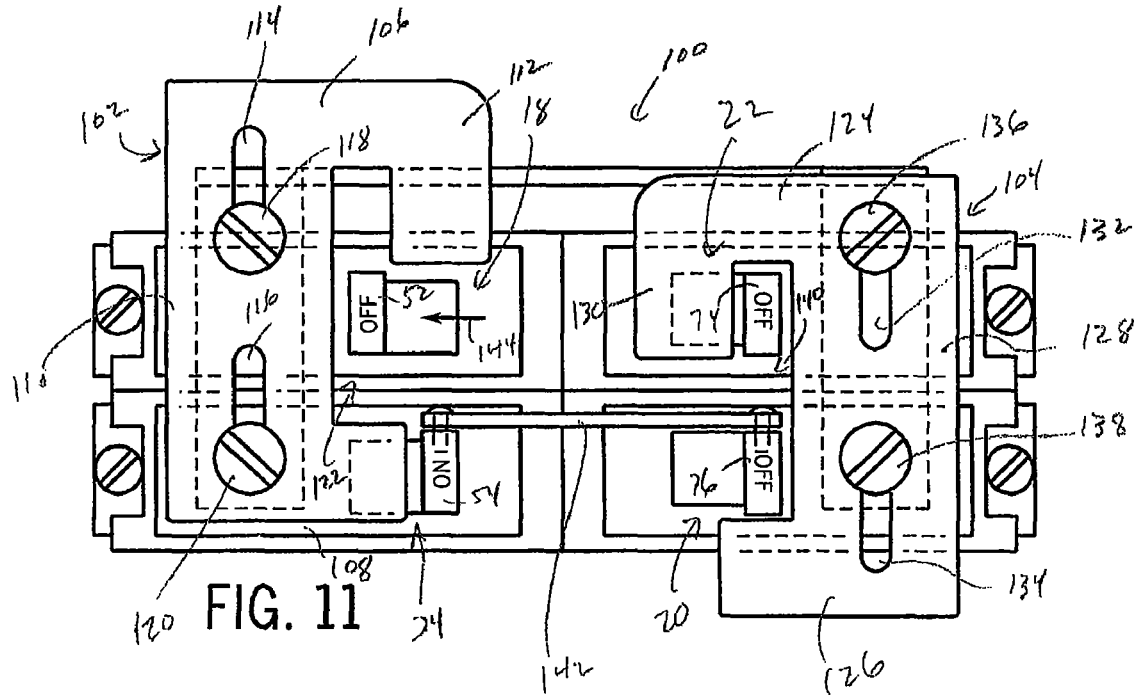
FIG. 11 is a front elevation view of the transfer panel shown in FIG. 10 with the utility mains breaker switched to an OFF position.

In the first step, shown in FIG. 11, the utility mains breaker handle 52 is moved outwardly in the direction of arrow 144 from the ON position to the OFF position. As a result of this outward movement, the switch handle 52 is moved to a position within recess 122 of the utility side lockout 102. Additionally, as a result of this movement, the switch handle 52 no longer blocks downward movement of the lockout 102. More specifically, when the switch handle 52 is in the ON position, FIG. 10, the shorted leg 112 of the lockout 102 is generally adjacent the switch handle 52. As a result, the lockout 102 cannot be slid downward along arrow 146, shown in FIG. 12.

Figure 12:
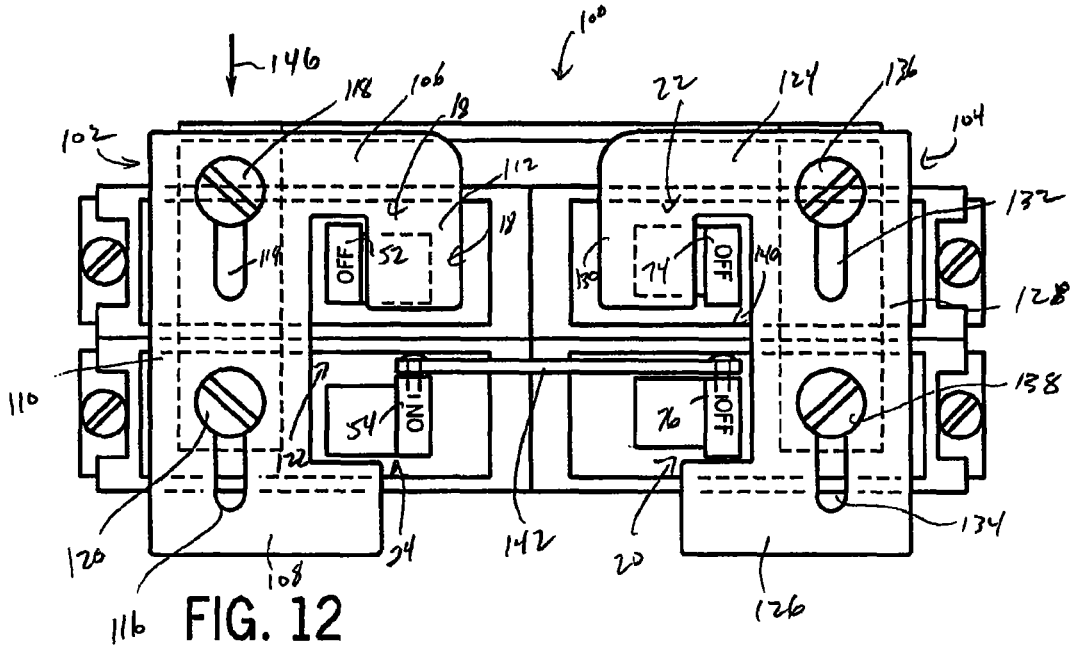
FIG. 12 is a front elevation view of the transfer panel shown in FIG. 10 with a mains side lockout sequencer having been slid to free the utility mains neutral switch.

In step 2, downward movement of the generator side lockout 102 causes the shorted leg 112 to move adjacent the utility mains breaker handle 52, as shown in FIG. 12. In this position, the switch handle 52 cannot be moved back to its ON position until the lockout 102 is slid upward. In addition, as shown in FIG. 12, the shortened base 108 of the lockout 102 also slides downward to a position below that of the utility mains neutral switch handle 54 thereby freeing the switch handle 54 to be moved to the OFF position.

Figure 13:
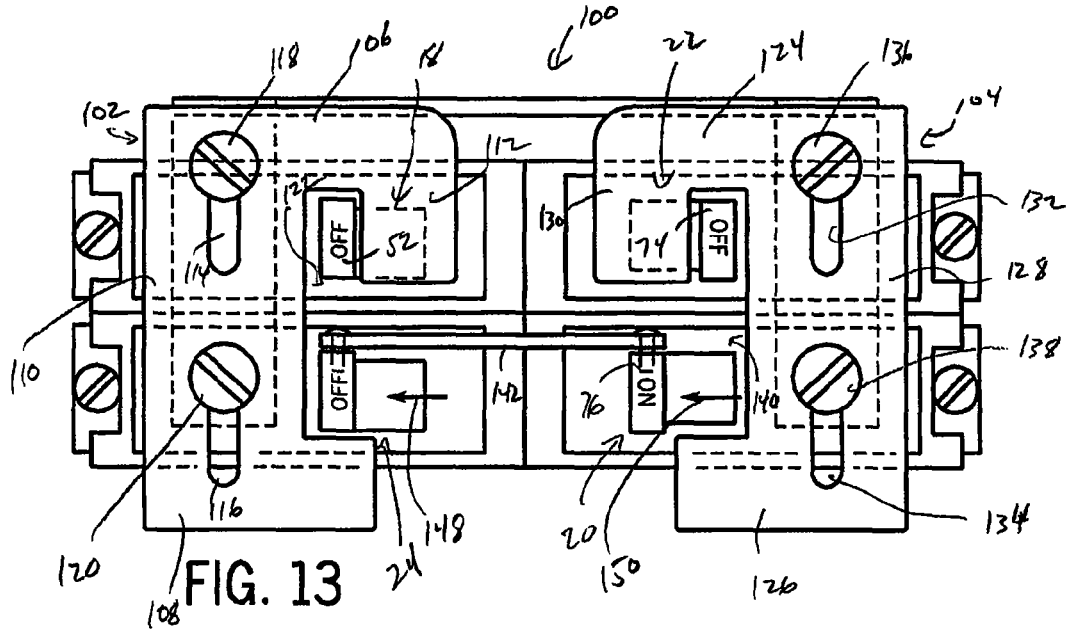
FIG. 13 is a front elevation view of the transfer panel shown in FIG. 10 with the utility mains breaker and the utility mains neutral switch switched to the OFF position and positioned within a recess formed in the mains side lockout sequencer and the generator mains neutral switch switched from the OFF position to the ON position.

Thus, at step 3, the utility mains neutral switch handle 54 is moved outwardly along arrow 148, as shown in FIG. 13. In this position, both of the utility side switches 52, 54 are in the OFF position as are the generator side switch handles 74, 76.

As such, the electrical loads are not being fed power from either power source. Further, because the utility mains neutral switch handle 54 is interlinked with the generator mains neutral switch handle 76, movement of the utility neutral switch handle 54 in the direction of arrow 148 automatically causes the generator mains neutral switch handle to move in the direct of arrow 150 from the OFF position, shown in FIG. 10, to the ON position.

When the generator mains neutral switch handle 74 is in the ON position, the generator side lockout 104 is freed to slide upwardly. More particularly, when the generator mains neutral switch handle 74 is in the OFF position, the switch handle 74 is adjacent the base 126 of the generator side lockout 104 and therefore impedes upward movement of the lockout 104.

Figure 14:
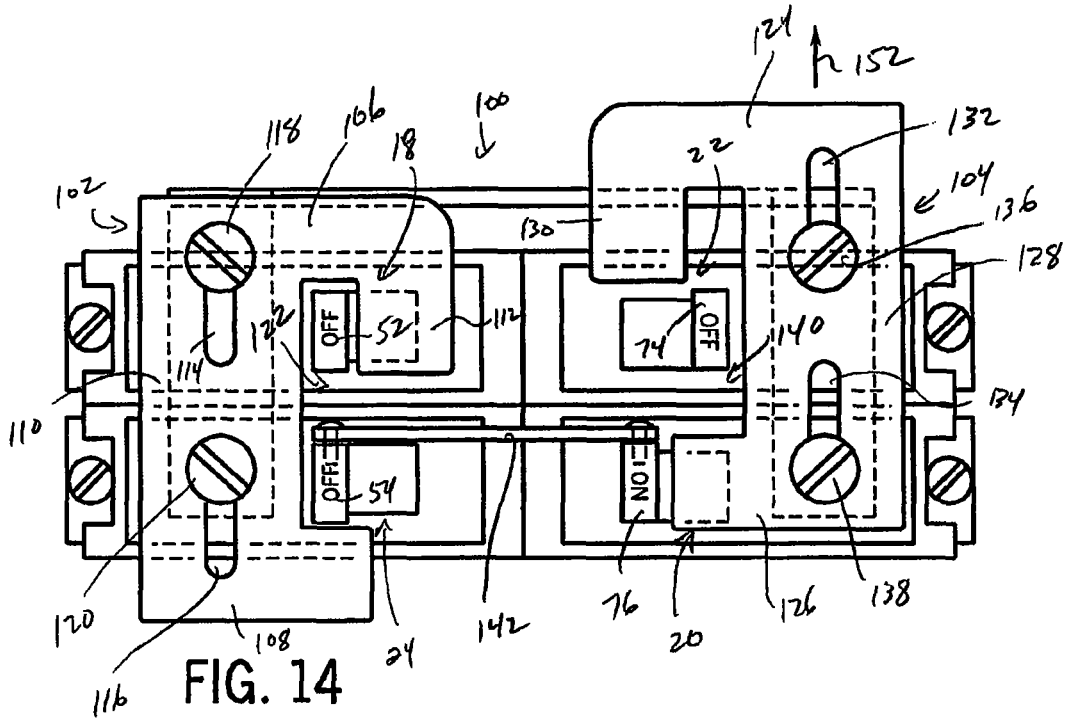
FIG. 14 is a front elevation view of the transfer panel shown in FIG. 10 with the generator side lockout sequencer having been slid to free the generator mains breaker.

In step 4, the generator side lockout 104 is slid upward in the direction of arrow 152, as shown in FIG. 14. As a result of this upward movement, the shorted leg 130 of the lockout 104 that previously was adjacent the generator mains breaker handle 74 is also moved upward away from the switch handle 74. Similarly, the base 126 of the lockout 104 slides upward and is positioned adjacent the generator mains neutral switch handle 76. In this position, the base 126 blocks the switch handle 76 from being moved back to its OFF position, which because of the interlinking of the neutral switches 54 and 76, also prevents the utility mains neutral switch 54 from being switched to the ON position.

Figure 15:
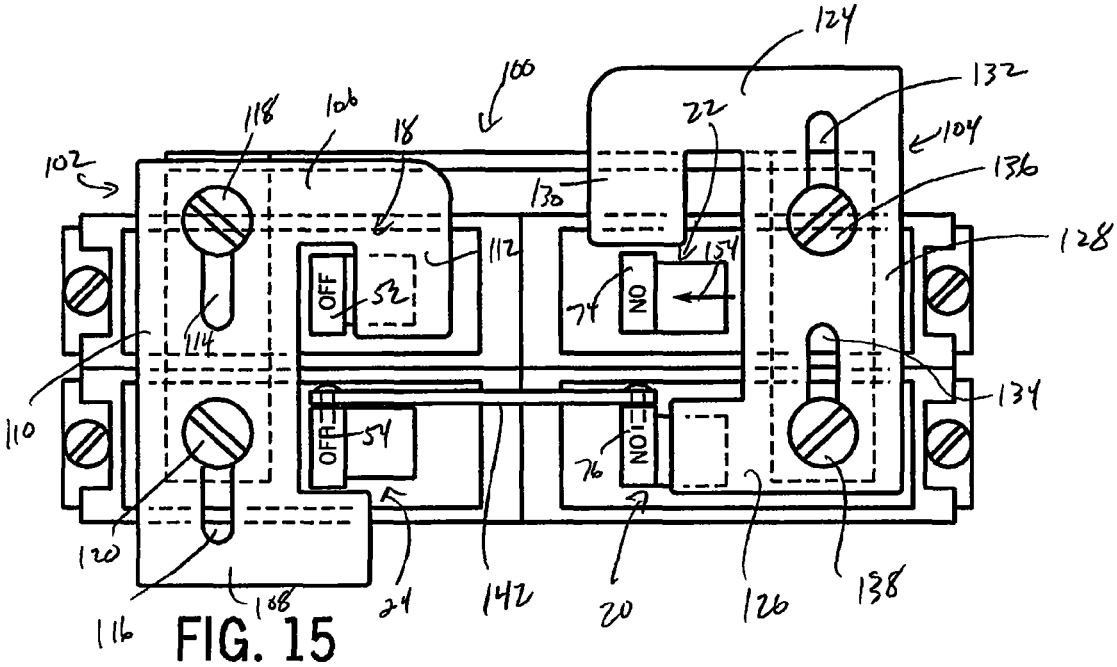
FIG. 15 is a front elevation view of the transfer panel shown in FIG. 10 with the generator mains breaker switch moved to the ON position thereby resulting in connection of a load to the generator power supply.

In step 5, shown in FIG. 15, the generator mains breaker handle 74 is switched from the OFF position to the ON position in the direction of arrow 154. When the generator mains breaker handle 74 is switched to the ON position, the load center is then electrically connected to the generator power source.

One skilled in the art will appreciate that the interlock assembly 100 forces an operator to first switch OFF the utility mains breaker, then switch OFF the utility mains neutral switch, which causes the generator mains neutral switch to be switched to the ON position, and then switch ON the generator mains breaker to disconnect the load center 10 from the utility power supply and connect it to the generator power supply. The mechanical configuration of the interlock assembly 100 does not allow the sequence to be adjusted by the operator. In addition, one skilled in the art will appreciate that the steps described above are carried out in reverse to disconnect the load center from the generator power source and connect it to the utility power source.

Figure 16:
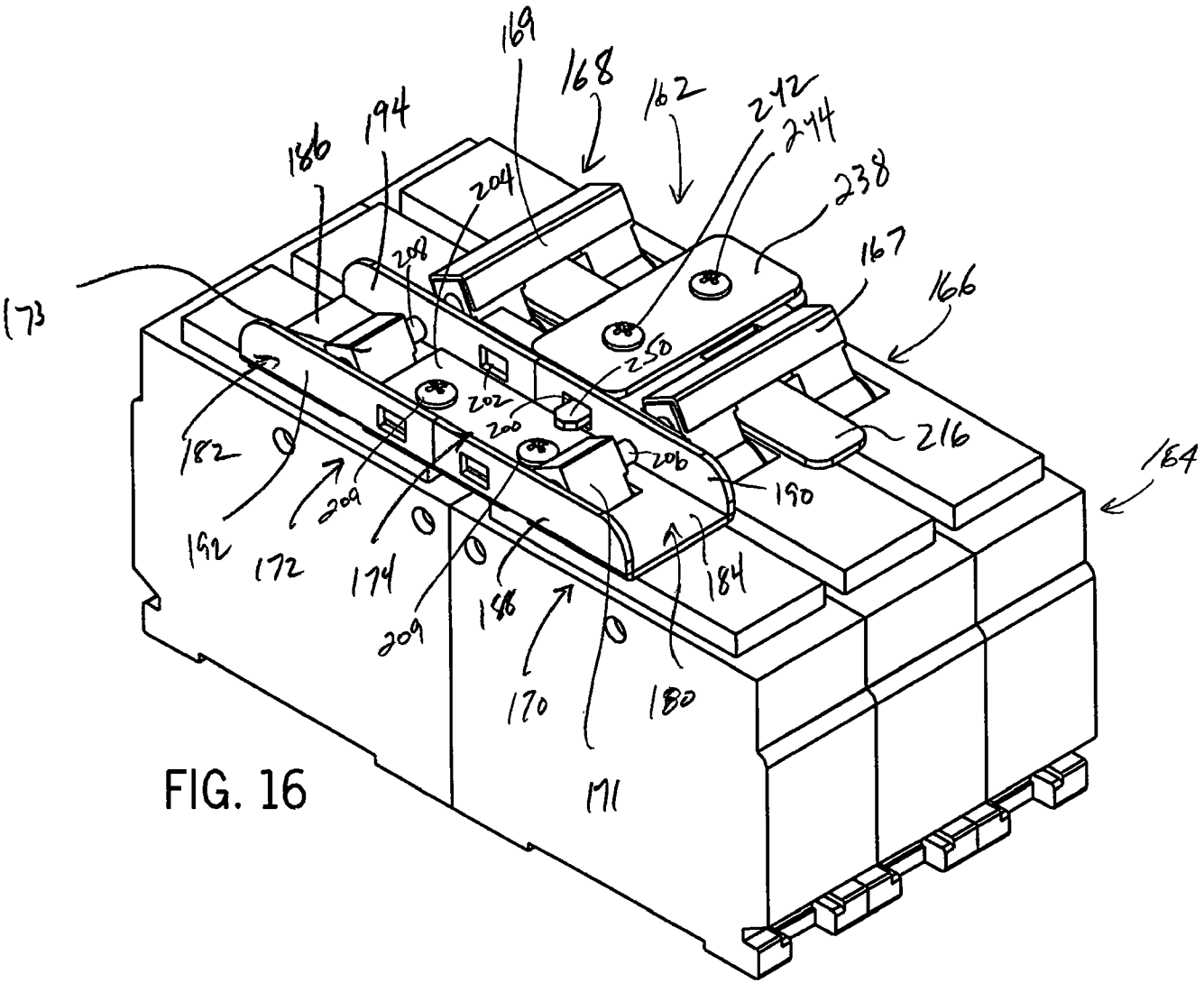
FIG. 16 is an isometric view of a lockout assembly according to another aspect of the invention and shown with a portion of an electrical panel having a utility mains breaker switch, a generator mains breaker switch, a utility neutral switch, and a generator neutral switch.

FIG. 16 shows a lockout assembly 162 according to another embodiment of the invention. Similar to the lockout assemblies described previously, lockout assembly 162 sequences switching of a separately-derived transfer switch in a pre-defined and fixed order to electrically disconnect an electrical panel from a primary power source and electrically connect the electrical panel to an alternate or secondary power source, such as an electric generator, and vice-versa. The lockout assembly 162 will be described with respect to a transfer switch apparatus 164 consisting of a utility mains breaker or switch 166 having a switch handle 167, and a generator mains breaker or switch 168 having a switch handle 169, that are generally aligned with one another such that a breaker is in a conductive ON position when switched toward the other breaker. Conversely, a breaker is in a non-conductive OFF position when switched away from the other breaker. The utility mains breaker 166 and the generator mains breaker 168 are each double-pole breakers and, as such, each includes a pair of switch members tied together in a manner that is known. The transfer switch apparatus 164 also includes a utility neutral switch 170 having a switch handle 171, and a generator neutral switch 172 having a switch handle 173, that are interlinked together so that the switches switch in tandem, as will be described in greater detail below.

Figure 17:
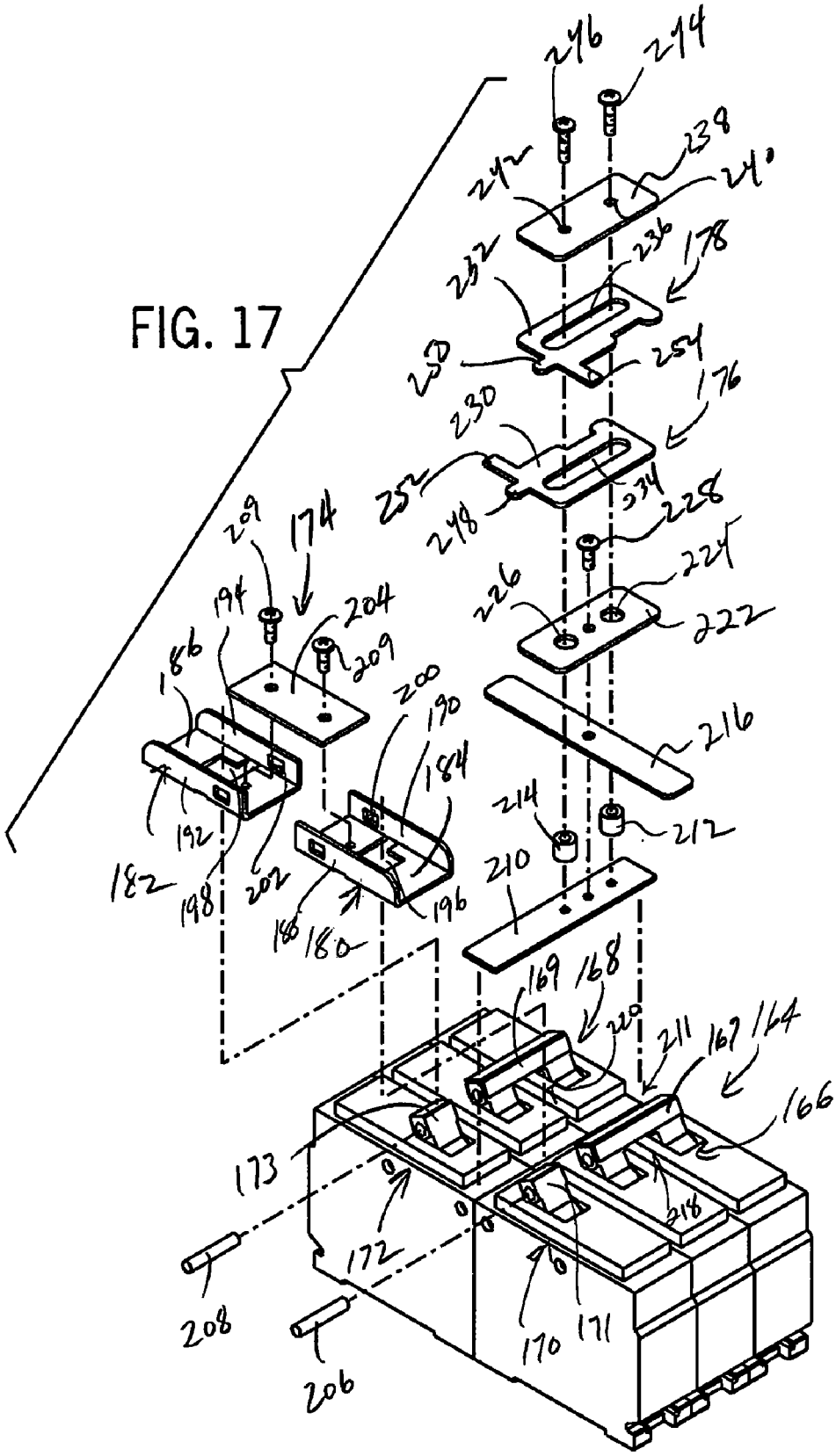
FIG. 17 is an exploded view of the lockout assembly of FIG. 16.

With additional reference to FIG. 17, the lockout assembly 162 is generally comprised of three separate lockout members 174, 176, and 178 that are arranged to define the order by which the transfer switch apparatus can be switched between power sources. Lockout member 174 interlinks the neutral switch 170, 172 and generally includes brackets 180 and 182 that interface with neutral switches 170 and 172, respectively. The brackets 180, 182 have a generally U-shape defined by a generally planar base 184, 186 and respective pairs of upturned walls 188, 190 and 192, 194. Openings 196, 198 are formed in planar bases 184, 186 and are sized to receive the switch handles of neutral switches 170 and 172, respectively. Additionally, openings 200, 202 are defined in upturned walls 190 and 194 of brackets 180 and 182, respectively. A bridging plate 204 is fastened to the planar bases 184, 186 so as to interlink the two bases. Each switch handle 171, 173 is configured to receive a pin or dowel 206, 208 to prevent the planar bases 184, 186 and the bridging plate 204 from being removed from engagement with the neutral switches 170, 172. In addition to interlinking planar bases 184, 186, the bridging plate 204 is also used as an actuator. The bridging plate 204 has a depth that is sufficient to engage the switch handles when the neutral switches 170, 172 are being manually switched. More particularly, when one neutral switch is being switched to the ON position, the switch handle will press against the bridging plate 204 which will then push against the opposite switch thereby causing the other switch to follow the movement of the first-mentioned switch. When a neutral switch is being switched to an OFF position, the bridging plate will pull the bracket for the other neutral switch in the same direction thereby causing the other switch to switch in the same direction, e.g., to its ON position. The bridging plate 204 is fastened to the brackets 180 and 182 by a pair of fasteners 209.

As further shown in FIG. 17, a support bar 210 is located in a channel 211 that extends between the utility mains and the generator mains breaker switch handles as well as the neutral switch handles. In this regard, the support bar 210 is located beneath brackets 180 and 182 of the neutral interlock 174 and does not interfere with operation of the neutral interlock 174 or the neutral switches 170, 172. A pair of posts 212, 214 extend upwardly from the support bar 210 and are generally aligned with one another. A base bar 216 is oriented transversely to the support bar 210 and sits atop the support bar 210 so as to pass through gaps 218 and 220 formed between the tied-together switch handles of the utility mains breaker 166 and the generator mains breaker 168, respectively.

An alignment plate 222 having a pair of holes 224, 226 is positioned atop the base bar 216 and the support bar 210 with the posts 212, 214 received by holes 224 and 226, respectively. A screw 228, or suitable fastener, interconnects the support bar 210, base bar 216, and the alignment plate 222. Lockout member 176, which includes a slide 230, is positioned atop the alignment plate 222 and lockout member 178, which includes a slide 232, is positioned atop slide 230. Slide 230 includes an elongated channel 234 that receives posts 212 and 214 and, similarly, slide 232 has an elongated channel 236 that also receives posts 212 and 214. In this regard, channels 234 and 236 are generally aligned with one another when the lockout assembly 162 is assembled. A retention plate 238 is used to secure the slides 230 and 232 in place, but does so in a manner that allows longitudinal displacement of the slides but prevents lateral displacement of the slides, as will be described. Plate 238 has a pair of holes 240 and 242 that are within the footprint of channels 234 and 236 and align with posts 212 and 214, respectively. A pair of fasteners 244 and 246 may then be used to secure the retention plate 238 to the posts 212 and 214 without impacting the slidability of the slides 230 and 232.

Slides 230 and 232 each have a protruding tab 248 and 250, respectively, that is designed to be received in a respective one of the openings 200, 202 of brackets 180, 182. When a slide is moved such that its tab is inserted into and received by one of the aforementioned openings, the neutral switches cannot be switched. That is, the slides are permitted to slide longitudinally about posts 212, 214 but cannot move laterally. In this regard, the slides prevent lateral movement of the brackets 180, 182 when engaged therewith by tabs 248, 250. Each slide 230, 232 also includes a leg 252 and 254, respectively. The legs 252, 254 extend along axes that are perpendicular to that of the tabs and are designed to block switching of the utility mains breaker 166 and the generator mains breaker 168, respectively, as will be described.

With reference now to FIGS. 18 through 23, the aforedescribed lockout assembly 162 and its lockout members 174, 176, and 178, sequences manual switching of the neutral switches and the mains breakers. More particularly, the lockout assembly 162 is designed and the lockouts 174, 176, and 178 are arranged such that the loads on the transfer switch may be disconnected from one power source and connected to another power source in five separate and unalterable steps or sequences.

Figure 18:
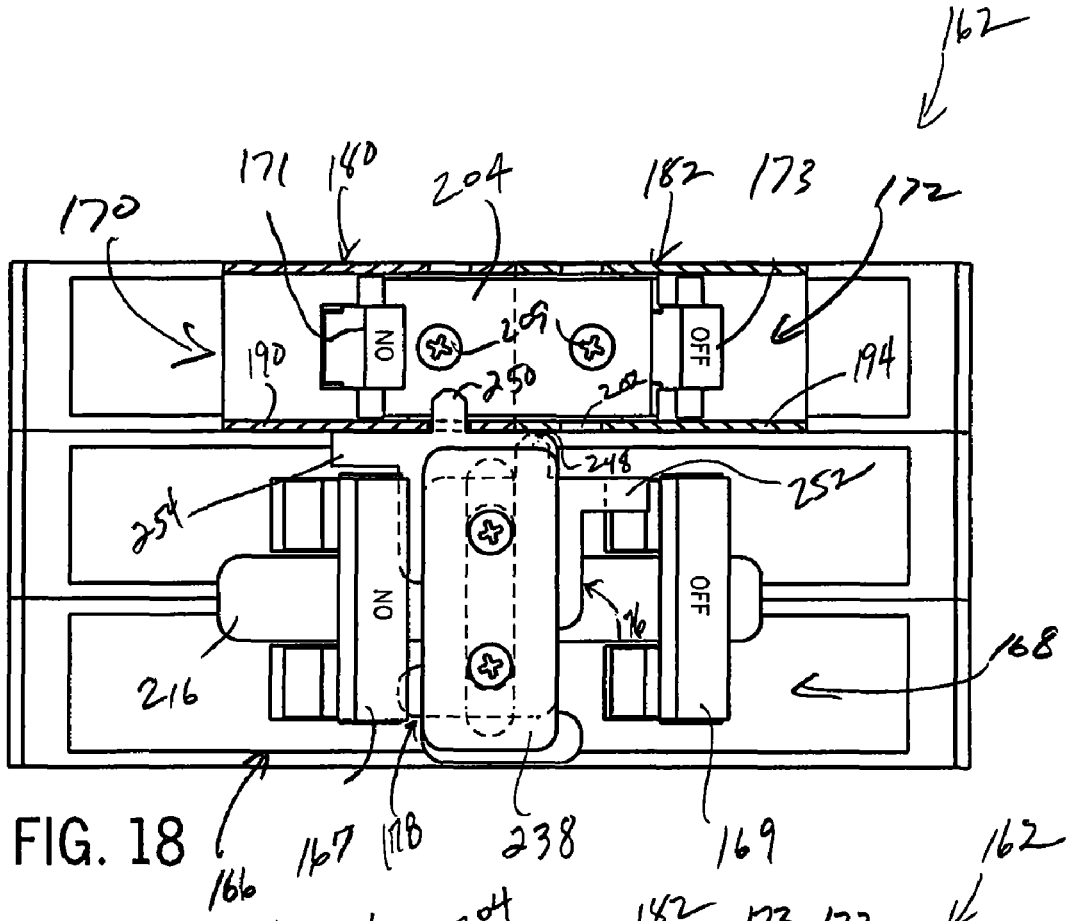
FIG. 18 is a front elevation view of the lockout assembly of FIG. 16 with the utility mains breaker and the utility neutral switch in conductive ON positions and the generator mains breaker and the generator neutral switch in non-conductive OFF positions.

In FIG. 18, the utility mains breaker switch handle 167 and the utility neutral switch handle 171 are in the conductive or ON position whereas the generator mains breaker switch handle 169 and the generator neutral switch handle 173 are in the non-conductive or OFF positions. With the switch handles in these positions, the tab 250 of slide 178 is received in opening 200 formed in the upturned wall 190 of bracket 180. When the opening 200 is aligned with tab 250 so that tab 250 may be received in the opening 200, opening 202 formed in the upturned wall 194 of bracket 182 is positioned out of alignment with tab 248 of slide 176. Moreover, the tab 248 is aligned with a solid portion of the upturned wall 194 adjacent the opening 202. As a result, tab 248 cannot be slid upward. Since the tab 248 cannot be slid upward, the leg 252 of slide 176 cannot be moved to clear switch handle 169. As such, the leg 252 blocks switching of switch handle 169 to the ON position. Additionally, with the tab 250 received within opening 200, the neutral switch handles 171 and 173 cannot be switched. As noted above, the switch handles 171, 173 are interlinked and therefore move in tandem during a switching action. It will thus be appreciated that with the lockout members 174, 176, and 178 positioned in the orientations shown in FIG. 18, the only permitted switch movement is switching of utility mains breaker 166 and, more particularly, switching of switch handle 167 away from switch handle 169 in the direction represented by arrow 256 to the OFF position, as shown in FIG. 19.

Figure 19:
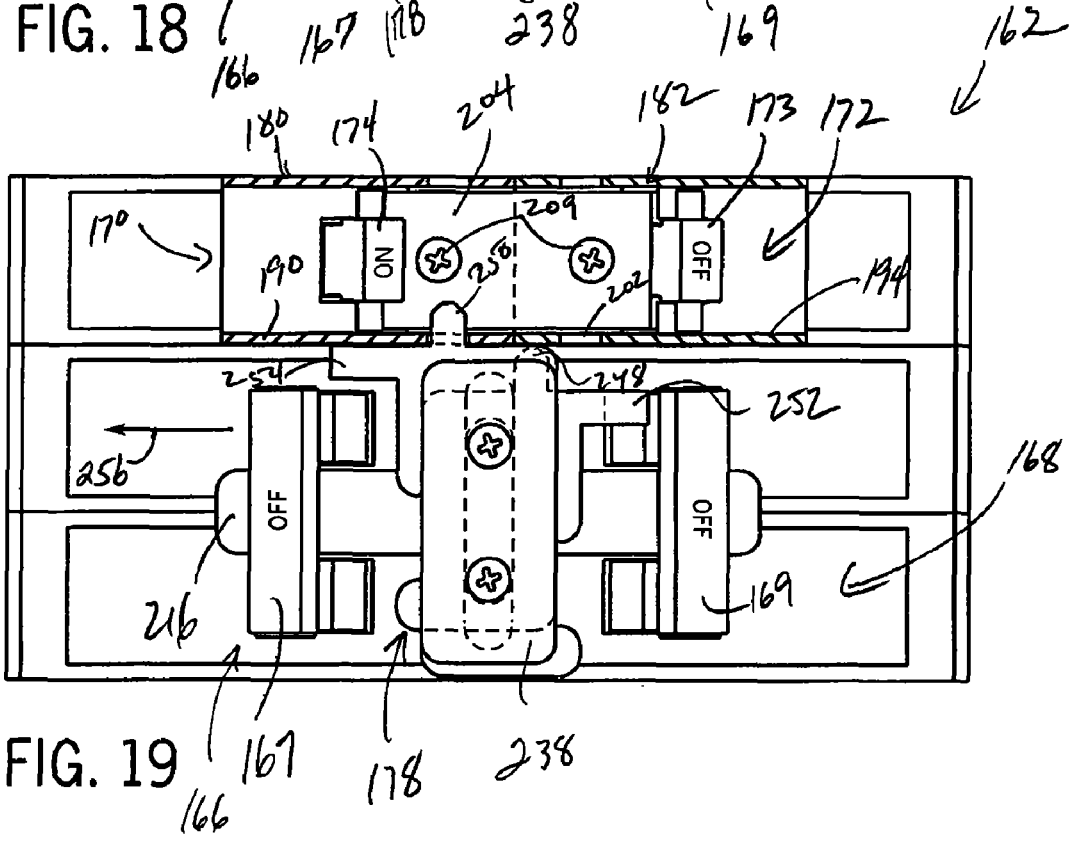
FIG. 19 is a front elevation view of the lockout assembly of FIG. 16 with the utility mains breaker in a non-conductive OFF position, the utility neutral switch in the conductive ON position, and the generator mains breaker and the generator neutral switch in non-conductive OFF positions.
Figure 20:
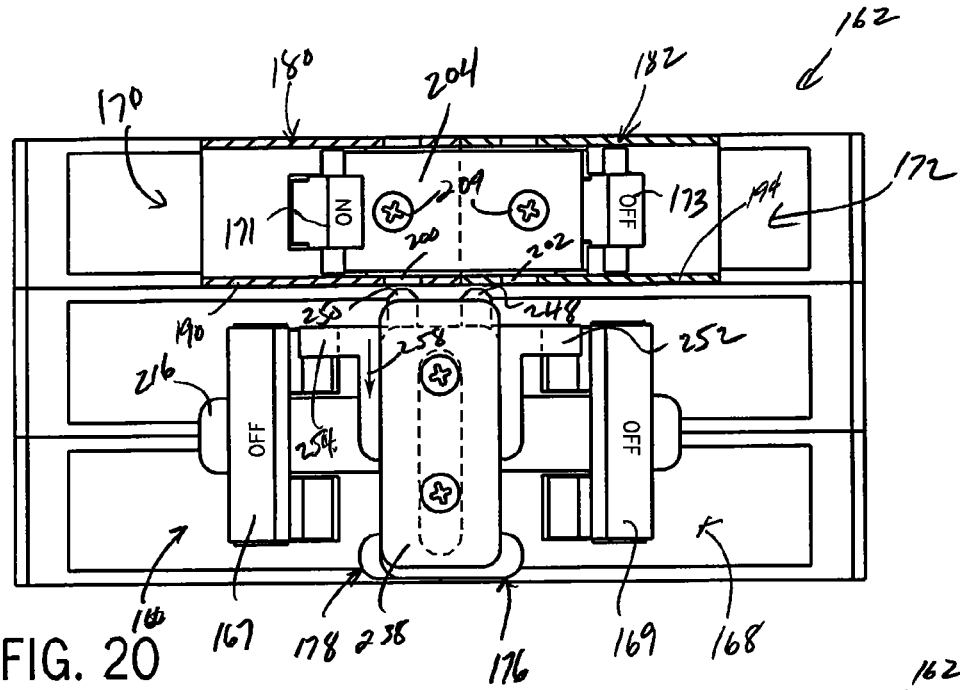
FIG. 20 is a front elevation view of the lockout assembly of FIG. 16 with a first movable interlock moved to clear switching of the neutral switches.
Figure 21:
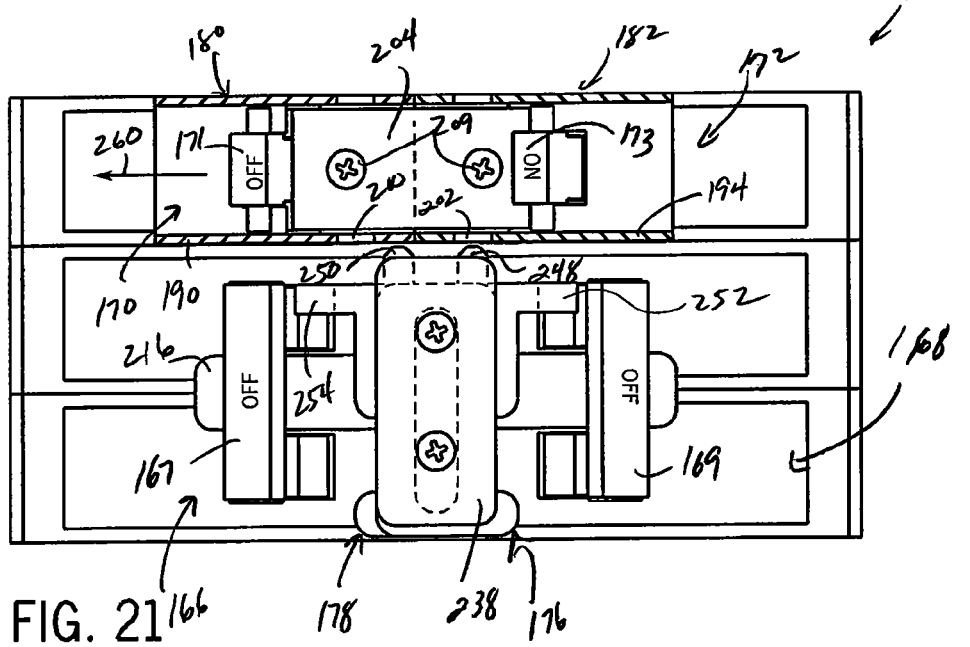
FIG. 21 is a front elevation view of the lockout assembly of FIG. 16 with the utility mains breaker and the utility neutral switch in non-conductive OFF positions, the generator neutral switch in a conductive ON position, and the generator mains breaker in a non-conductive OFF position.

As shown in FIG. 19, when the utility mains breaker 166 is switched to the OFF position (step 1), the leg 254 of slide 178 is no longer blocked by the switch handle 167 and, as such, the slide 178 may be slid downward in the direction of arrow 258 to withdraw tab 250 from opening 200 (step 2), as shown in FIG. 20. With the slide 178 slid downward to withdraw tab 250 from opening 200, movement of the brackets 180, 182, and thus neutral switches 170, 172, is no longer prevented by slide 178. As such, the neutral switch handle 171 may be moved in the direction of arrow 260 to the OFF position (step 3). Since the neutral switch handles 171, 173 are interlinked by the aforedescribed lockout 174, switch handle 173 follows movement of switch handle 171 in the direction of arrow 260 to the ON position, as shown in FIG. 21. Preferably, the neutral switches and the neutral lockout are constructed such that when a switch handle is moved to the OFF position, the opposite switch handle moves to the ON position in tandem but is placed in the ON position slightly after the switch handle is in the OFF position. In this regard, a neutral switch handle is not placed in the ON position until after the opposite neutral switch handle is in the OFF position.

Figure 22:
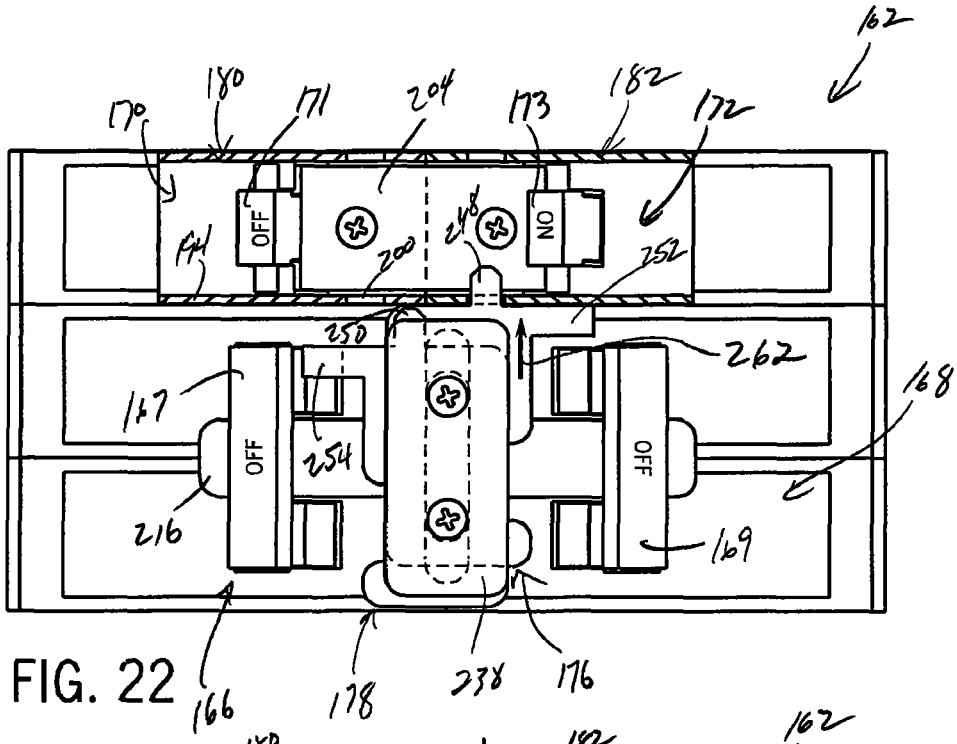
FIG. 22 is a front elevation view of the lockout assembly of FIG. 16 with a second movable interlock moved to clear switching of the generator mains breaker.
Figure 23:
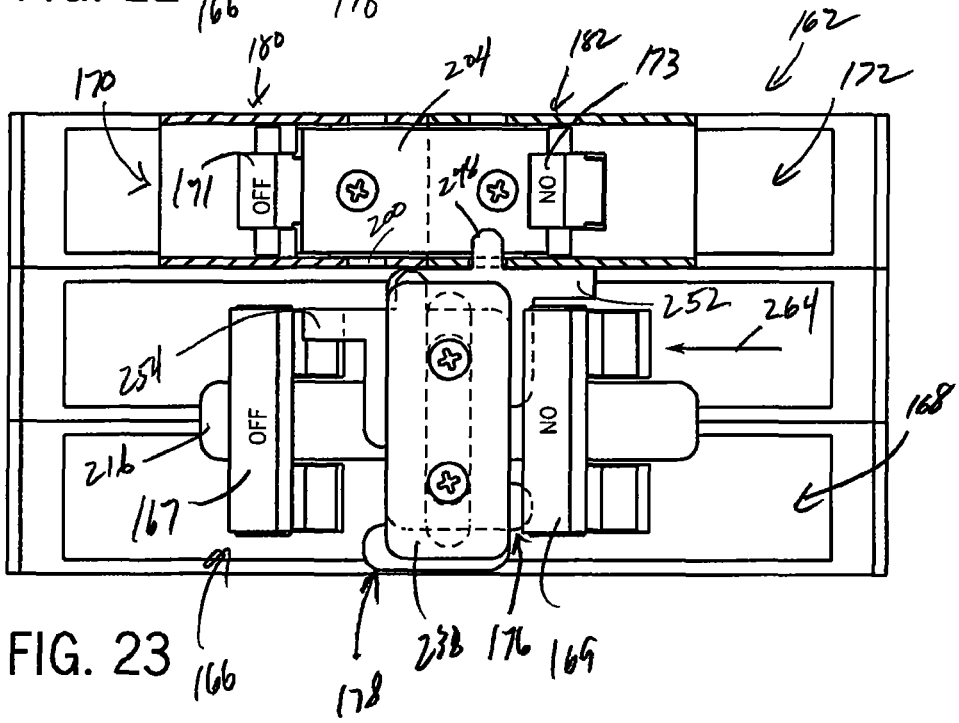
FIG. 23 is a front elevation view of the lockout assembly of FIG. 16 with the utility mains breaker and utility neutral switch in non-conductive OFF positions and the generator mains breaker and the generator neutral switch in conductive ON positions.

As a result of the switching of the mains neutral switch handle 171 to the OFF position and the generator neutral switch handle 173 to the ON position, opening 202 of bracket 182 will align with tab 248 of slide 176. As such, slide 176 may be slid upward in the direction of arrow 262 (step 4) to insert tab 248 into opening 202, as shown in FIG. 22. When the tab 248 is inserted into the opening 202, the neutral switches 170, 172 cannot be moved. Movement of the slide 176 upward also moves its leg 252 upward to free the generator mains breaker 168 so that its switch handle 169 can be moved in the direction of arrow 264 from the OFF position to the ON position (step 5) as shown in FIG. 23.

One skilled in the art will appreciate that the interlock assembly 162 forces an operator to first switch OFF the utility mains breaker, then switch OFF the utility mains neutral switch, which causes the generator mains neutral switch to be switched to the ON position, and then switch ON the generator mains breaker to disconnect the load center 10 from the utility power supply and connect it to the generator power supply. The mechanical configuration of the interlock assembly 162 does not allow the sequence to be adjusted by the operator. In addition, one skilled in the art will appreciate that the steps described above are carried out in reverse to disconnect the load center from the generator power source and connect it to the utility power source.

While the embodiments of the invention have been shown and described in connection with manual movement of the various components, it should also be understood that movement of some or all of the components may be accomplished using conventional actuating devices.

Various alternatives and embodiments are contemplated as being within the scope of the following claims particularly pointing out and distinctly claiming the subject matter regarded as the invention.

We claim:

1. A lockout assembly for use with a separately-derived transfer switch having a mains switch, a generator switch, a mains neutral switch, and a generator neutral switch, the arrangement comprising:

a neutral interlock associated with the mains neutral switch and the generator neutral switch, and configured to prevent both neutral switches from being in a conductive position simultaneously, the neutral interlock including a first bracket engaged with the mains neutral switch and a second bracket engaged with the generator neutral switch, the brackets adapted to move in response to movement of a neutral switch;

a first interlock configured to engage the first bracket to prevent movement of the first bracket and a second interlock configured engage the second bracket to prevent movement of the second bracket; and wherein the first and second interlocks are arranged such that the interlocks cannot be engaged with their respective brackets simultaneously.

2. The lockout assembly of claim 1 wherein the first bracket has a first notch and the second bracket has a second notch and wherein the first interlock has a first tab and the second interlock has a second tab, and wherein the tabs are sized to be received in the respective notches when the interlocks are engaged with the brackets, and wherein a tab, when received in a notch of a bracket, prevents movement of the bracket.

3. The lockout assembly of claim 2 wherein the first bracket has an upturned wall and the first notch is formed in the upturned wall and wherein the second bracket has an upturned wall and the second notch is formed in the upturned wall, and wherein the first bracket further comprises an opening to receive a switch handle of the mains neutral switch and the second bracket further comprises an opening to receive a switch handle of the generator neutral switch, and wherein manual movement of a switch handle causes movement of an associated bracket when the bracket is not prevented from movement by one of the first and the second interlocks.

4. The lockout assembly of claim 2 wherein the first interlock includes a body, the tab extending normal from the body, and a leg extending axially from the body, wherein the leg is adapted to prevent movement of the mains switch when the second interlock is engaged with the second bracket and wherein the second interlock includes a body, the tab extending normal from the body, and a leg extending axially away from the body, wherein the leg is adapted to prevent movement of the generator switch when the first interlock is engaged with the first bracket.

5. The lockout assembly of claim 4 further comprising a base bar having at least one upwardly extending post, the base bar positioned between the mains switch and the generator switch and along an axis that is normal to switching axis of the mains switch and the generator switch, and wherein the bodies of the first and second interlocks each include a channel and the at least one post extends upwardly from the base bar through the channels, and wherein the interlocks are movable along a normal axis defined by the channels to selectively engage the tabs with the brackets of the neutral interlock.

6. The lockout assembly of claim 5 wherein the first interlock is arranged such that the mains switch cannot be switched to a conductive position until the mains neutral switch has been moved to a conductive position and the body of the first interlock has moved along the normal axis defined by the channels to cause the tab extending from the body of the first interlock to engage the notch in the first bracket and to cause the leg of the first interlock to clear the mains switch.

7. The lockout assembly of claim 6 wherein the second interlock is arranged such that the generator switch cannot be switched to a conductive position until the generator neutral switch has been moved to a conductive position and the body of the second interlock has moved along the normal axis defined by the channels to cause the tab extending from the body of the second interlock to engage the notch in the second bracket and to cause the leg of the second interlock to clear the generator switch.

8. The lockout assembly of claim 7 wherein the neutral interlock and the first and the second interlocks are arranged such that a neutral switch cannot be moved from a conductive position to a non-conductive position until after the switch associated with the neutral switch has first been moved to a non-conductive position.

9. The lockout assembly of claim 8 wherein the neutral interlock and the first and the second interlocks are arranged such that one of the mains neutral switch and the generator neutral switch cannot be moved from a non-conductive position to a conductive position until after the switch associated with the other one of the mains neutral switch and the generator neutral switch has been moved from a conductive position to a non-conductive position.

10. The lockout assembly of claim 1 wherein the neutral interlock and the first and the second interlocks are arranged such that the transfer switch may be disconnected from one power supply and connected to another power supply in no more than 5 sequentially carried out movements of the neutral interlock and the first and the second interlocks.

11. A separately-derived transfer switch for switchably connecting a load to either a first power supply or a second power supply, the transfer switch comprising:

a first main switch associated with the first power supply;

a second main switch associated with the second power supply;

a first neutral switch associated with the first power supply;

a second neutral switch associated with the second power supply;

a lockout sequencer arrangement having a first lockout that restricts simultaneous switching of the first and the second neutral switches, a second lockout configured to engage the first lockout to restrict movement of the first lockout when the first main switch is a conductive position, and a third lockout configured to engage the first lockout to restrict movement of the first lockout when the second main switch is in a conductive position.

12. The transfer switch of claim 11 wherein the first interlock comprises a pair of opposed brackets that includes a first bracket engaged with the first neutral switch and a second bracket engaged with the second neutral switch, wherein the first interlock further includes a linking member interconnecting the pair of brackets, and wherein the linking member is further configured to exert a force against one of the first neutral switch and the second neutral switch when the other one of the first neutral switch and the second neutral switch is being switched, wherein the force is sufficient to switch the one of the first neutral switch and the second neutral switch.

13. The transfer switch of claim 12 wherein the linking member is engaged with the pairs of brackets such that the first and the second brackets slide in unison in response to a switching action of either one of the first and the second neutral switches.

14. The transfer switch of claim 13 wherein the second interlock is movable along an axis normal to the first interlock and includes a tab and wherein the third interlock is movable along an axis normal to the first interlock and includes a tab, and wherein each bracket of the pair of brackets includes a notch adapted to receive a respective one of the tabs when the second and third interlocks are engaged with the first interlock.

15. The transfer switch of claim 14 wherein each bracket includes an upturned wall and each notch is formed in a respective one of the upturned walls, and wherein each upturned wall includes a portion adjacent its respective notch that prevents one of the second and the third interlocks from being moved into engagement with the first interlock when the other one of the second and third interlocks is engaged with the first interlock.

16. The transfer switch of claim 14 further comprising a base bar having at least one upwardly extending post, the base bar positioned between the first main switch and the second main switch and along an axis that is normal to a switching axis of the first main switch and the second main switch, and wherein the second and third interlocks are configured to slidably receive the at least one post in a manner that allows limited movement of the second and third interlocks about the post along an axis that is normal to the first interlock and the switching axis of the first main switch and the second main switch.

17. The transfer switch of claim 16 wherein the at least one post includes two posts aligned with and spaced from one another.

18. The transfer switch of claim 16 wherein the first main switch is a double-pole switch having a first pair of switch handles linked together by a bridging member such that a gap is formed between the switch handles, and wherein the second main switch is a double-pole switch having a second pair of switch handles linked together by a bridging member such that a gap is formed between the switch handles, and further comprising another base bar positioned between the first main switch and the second main switch such that the second-mentioned base bar extends through the gaps formed between the pairs of switch handles and wherein the first-mentioned base bar is fastened to the second-mentioned base bar, and wherein the second-mentioned base bar extends along an axis that is orthogonal to that of the first-mentioned base bar.

19. The transfer switch of claim 16 further comprising at least one fastener engaging the at least one post and configured to substantially limit lateral movement of the third and the fourth lockouts.

20. A method of disconnecting a load from a mains power supply and connecting the load to a generator, comprising:

(a) switching a mains switch from an ON position to an OFF position; then (b) disengaging a mains side lockout from engagement with a neutral switch assembly lockout to allow movement of a mains neutral switch and a generator neutral switch; then (c) switching, in tandem, the mains neutral switch from an ON position to an OFF position and the generator neutral switch from an OFF position to an ON position; then (d) engaging a generator side lockout with the neutral switch assembly lockout to prevent switching of the mains neutral switch and the generator neutral switch; and then (e) switching a generator switch from an OFF position to an ON position.

21. The method of claim 20 wherein the neutral switch lockout assembly is movable along a first axis and the mains side lockout and the generator side lockout are movable along parallel second and third axes that are normal to the first axis.

* * * * *

UNITED STATES PATENT AND TRADEMARK OFFICE

CERTIFICATE OF CORRECTION

PATENT NO. : 8,138,433 B2
APPLICATION NO. : 12/608517
DATED : March 20, 2012
INVENTOR(S) : Neil A. Czarnecki et al.

It is certified that error appears in the above-identified patent and that said Letters Patent is hereby corrected as shown below:

IN THE CLAIMS

CLAIM 1, column 12, line 5, after "configured" insert -- to --;

CLAIM 11, column 14, line 17, after "is" insert -- in --.

Signed and Sealed this
Twenty-fourth Day of April, 2012

David J. Kappos

David J. Kappos
*Director of the United States Patent and Trademark Office*